US007786879B2

(12) United States Patent
Lax

(10) Patent No.: US 7,786,879 B2
(45) Date of Patent: Aug. 31, 2010

(54) SELF-POWERED RECHARGEABLE SMOKE/CARBON MONOXIDE DETECTOR

(75) Inventor: Samuel Lax, Mission Hills, CA (US)

(73) Assignee: L.I.F.E. Support Technologies, LLC, Mission HIlls, CA (US)

( * ) Notice: Subject to any disclaimer, the term of this patent is extended or adjusted under 35 U.S.C. 154(b) by 246 days.

(21) Appl. No.: 11/686,789

(22) Filed: Mar. 15, 2007

(65) Prior Publication Data

US 2007/0285262 A1 Dec. 13, 2007

Related U.S. Application Data

(63) Continuation-in-part of application No. 11/422,666, filed on Jun. 7, 2006.

(51) Int. Cl.
*G08B 17/10* (2006.01)

(52) U.S. Cl. ..... 340/628; 340/632; 340/500; 340/532

(58) Field of Classification Search ..... 340/628–632, 340/500, 532
See application file for complete search history.

(56) References Cited

U.S. PATENT DOCUMENTS

| | | | | |
|---|---|---|---|---|
| 4,148,023 | A | 4/1979 | Elkin | |
| 4,166,960 | A | 9/1979 | Meili | |
| 4,199,754 | A | 4/1980 | Johnson et al. | |
| 4,419,658 | A * | 12/1983 | Jarosz et al. | 340/521 |
| 4,570,155 | A | 2/1986 | Skarman et al. | |
| 4,649,376 | A | 3/1987 | Frank | |
| 4,763,115 | A | 8/1988 | Cota | |
| 4,801,928 | A | 1/1989 | Minter | |
| 4,808,977 | A | 2/1989 | Hedrick | |
| 4,827,244 | A | 5/1989 | Bellavia et al. | |
| 4,937,562 | A * | 6/1990 | Kaminaka et al. | 340/693.6 |
| 4,965,556 | A * | 10/1990 | Brodecki et al. | 340/628 |
| 5,140,301 | A | 8/1992 | Watanabe | |
| 5,572,183 | A | 11/1996 | Sweeney | |
| 5,574,436 | A * | 11/1996 | Sisselman et al. | 340/663 |
| 5,612,665 | A | 3/1997 | Gerhardsen | |
| 5,745,040 | A * | 4/1998 | Loughridge | 340/628 |
| 6,150,943 | A | 11/2000 | Lehman et al. | |
| 6,181,251 | B1 | 1/2001 | Kelly | |
| 6,271,605 | B1 * | 8/2001 | Carkner et al. | 307/125 |
| 6,323,780 | B1 * | 11/2001 | Morris | 340/692 |
| 6,522,254 | B1 * | 2/2003 | Yamano | 340/630 |
| 6,661,346 | B1 * | 12/2003 | Wood et al. | 340/601 |
| 6,696,967 | B1 * | 2/2004 | Rutter et al. | 340/632 |
| 6,753,786 | B1 * | 6/2004 | Apperson et al. | 340/628 |
| 7,026,945 | B2 * | 4/2006 | Hill | 340/652 |
| 2001/0038336 | A1 * | 11/2001 | Acevedo | 340/628 |

* cited by examiner

*Primary Examiner*—Eric M Blount
(74) *Attorney, Agent, or Firm*—Kelly Lowry & Kelley, LLP

(57) ABSTRACT

A rechargeable smoke and carbon monoxide detector is provided. The base of the detector has a battery formed therein that is charged when connected to a power source, such as a 110-volt light bulb socket. The detector is further configured to receive a 110-volt light bulb so as to not eliminate the use of the light socket as a light source. Additionally, the detector may include one or more warning devices such as an ionization or photoelectric sensor, speaker, or light source. A power indicator LED, a smoke indicator LED, and a carbon monoxide indicator LED all provide visual notification that the detector is functioning properly.

20 Claims, 2 Drawing Sheets

SELF-POWERED RECHARGEABLE SMOKE/CARBON MONOXIDE DETECTOR

BACKGROUND OF THE INVENTION

This invention relates generally to a combination smoke and carbon monoxide detector. More particularly, the invention relates to a smoke and carbon monoxide detector that is self-powered and rechargeable.

Smoke detectors are well known in the prior art. Two examples of modern smoke alarms are provided in U.S. Pat. No. 4,827,244 to Bellavia and U.S. Pat. No. 4,166,960 to Meili. Typically, smoke detectors provide an audible alarm to alert nearby people of a fire. Smoke detectors may also include lights to help direct persons toward exits during the course of a fire.

Improved smoke detectors not only sound an alarm when smoke is detected, but also activate powerful lights or flashing strobes to help direct people to an exit. For example, U.S. Pat. No. 4,649,376 to Frank discloses the use of powerful flashing xenon lamps to pierce smoke and direct people to an exit. Other examples of such visual technology are disclosed in U.S. Pat. Nos. 4,148,023 to Elkin, 4,570,155 to Skarman, and 4,763,115 to Cota. While these devices are useful is some circumstances, the flashing incandescent lights can tend to daze or confuse, rather than direct, persons, especially in a smoky room where the orientation of the flashes may not be readily apparent. Furthermore, intense flashing lights destroy night vision and may cause more harm than good to confused persons attempting to escape a dark and smoky building.

U.S. Pat. No. 4,763,115 to Cota further discloses the use of a redundant circuit that activates by a central audible alarm to trigger a smoke alarm and flashing circuits. U.S. Pat. No. 5,572,183 to Sweeney discloses a device that sweeps a laser beam across a plurality of mirrors. Each mirror directs the laser beam onto the floor at a different location. The path of the laser beams move toward a building exit. U.S. Pat. No. 5,140,301 to Watanabe further discloses a centrally controlled smoke detector network that generates a laser, which is guided and oscillated by a controlling mirror, to direct persons to a building exit point.

U.S. Pat. No. 6,181,251 to Kelly also discloses a smoke detector that includes a pulse laser in a single housing with a detection means. The pulse laser is mounted on a laser point means which allows for pointing the laser in multiple directions.

The prior art does not teach a multi-powered fire alarm comprising rechargeable and removable batteries. Further, there is a need for a self-powered, rechargeable fire alarm that continues to function even when not hard-wired or powered by a "traditional" 9-volt battery. Moreover, the prior art does not disclose a system for deactivating a fire alarm absent actuating a device located on the exterior of the detector unit.

Accordingly, a self-powered rechargeable smoke and carbon monoxide detector is needed. Such a detector should include a base unit that connects directly into a 110-volt light bulb socket thereby requiring no battery maintenance and no need for drilling holes or otherwise using hand tools to install the detector. Moreover, the smoke and carbon monoxide detector should include a socket for reception of a 110-volt light bulb, thereby not precluding use of the 110-volt socket as a light source. The smoke and carbon monoxide detector should also include a means for quickly and easily silencing the alarm without actually touching the detector. The present invention fulfills these needs and provides further related advantages.

SUMMARY OF THE INVENTION

The present invention relates to a system for detecting smoke and/or carbon monoxide comprising a base unit including a smoke detector and a carbon monoxide detector formed therein. The base is self-powered and rechargeable via a 110-volt socket formed at one end. The smoke and carbon monoxide detector has an opposite 110-volt socket for receiving a corresponding light bulb, thereby retaining the use of the socket as a light source. A battery integral to the base of the smoke and carbon monoxide detector is continually charged when in electrical communication with a power source via the 110-volt electrical socket.

Furthermore, the smoke and carbon monoxide detector of the present invention has an outer casing and electronic circuitry resistant to corrosion and moisture. Most notably, the circuitry of the smoke detector, the circuitry of the carbon monoxide detector, and the circuitry of the battery include a spray-on silicon substance for such protection.

In an alternative embodiment, the smoke and carbon monoxide detector of the present invention may incorporate an ionization sensor and photoelectric sensor to enhance the detection of a fire hazard.

For notification, the present invention further includes an alarm associated with the smoke detector and the carbon monoxide detector. The alarm is tested by flipping a light switch on/off in predetermined successive repetitions. Furthermore, the smoke and carbon monoxide detector alarm is deactivated by flipping the same light switch on/off in a different predetermined set of repetitions. The light switch is electrically wired to the 110-volt light bulb socket. The light switch regulates the flow of electricity to the socket. Without the detector, the light switch functions as a standard on/off light switch.

The smoke and carbon monoxide detector of the present invention also includes a variety of warning indicators including a speaker that issues an audible alarm or pre-recorded message. Additionally, a power indicator LED, a smoke detector indicator LED, and a carbon monoxide detector indicator LED provide external visual notification that the smoke and carbon monoxide detector is properly powered and functioning.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE PREFERRED EMBODIMENTS

Figure 1:
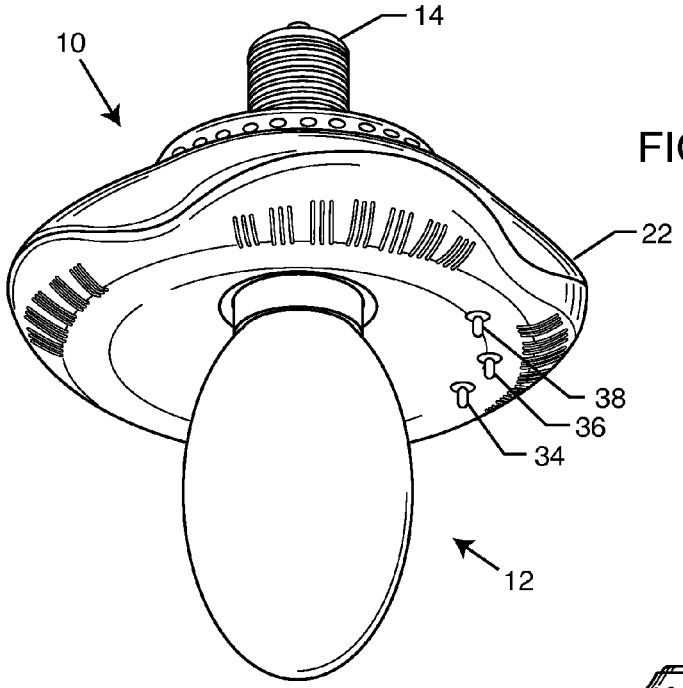
FIG. 1 is a perspective view of a smoke and carbon monoxide detector on the present invention, incorporating a 110-volt light bulb.
Figure 2:
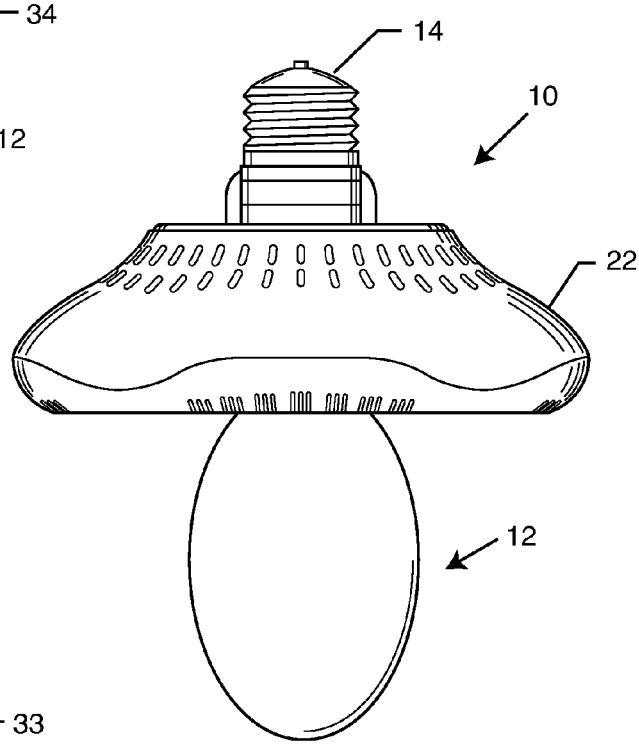
FIG. 2 is a side view of the detector of FIG. 1.
Figure 3:
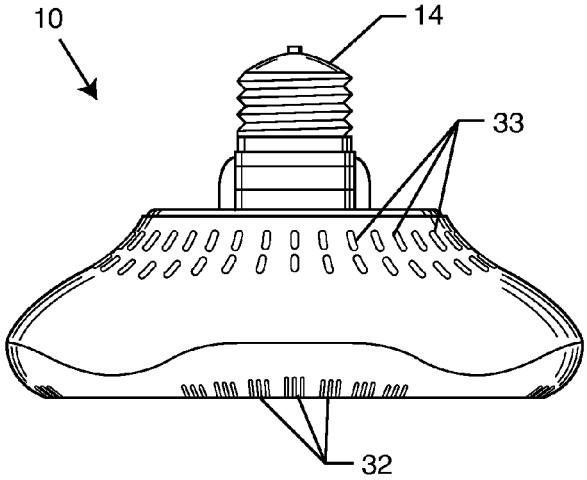
FIG. 3 is an alternative embodiment of FIG. 2, excluding the 110-volt light bulb.
Figure 4:
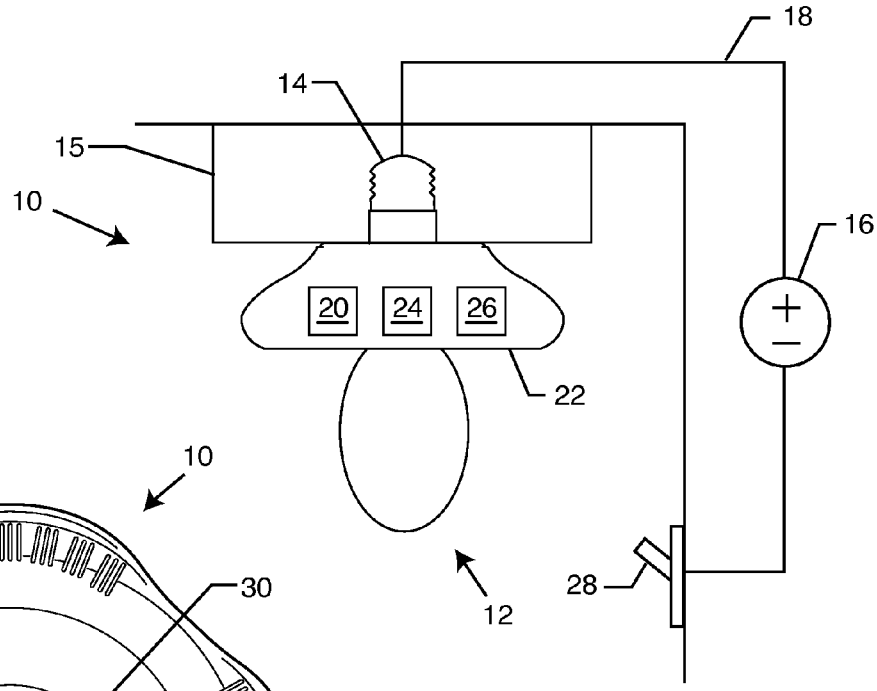
FIG. 4 is a schematic view of the present invention illustrating the electrical connections.

As shown in the exemplary drawings for purposes of illustration, the present disclosure for a combination smoke and carbon monoxide detector that is self-powered and rechargeable is referred to generally by the reference numeral 10. Turning now to the representative figures in the specification, FIG. 1 illustrates the smoke and carbon monoxide detector 10 including a 110-volt light bulb 12 and an oppositely protruding light bulb socket connector 14. The light bulb socket connector 14, as shown in FIGS. 1-3, fits directly into a standard fixture 15 (FIG. 4). Placing the smoke and carbon monoxide detector 10 within an existing light fixture via the light bulb socket connector 14 eliminates any unsightly smoke or carbon monoxide detectors, eliminates any issues with dead batteries, and eliminates any need for a do-it-yourself installation of a new smoke detector or carbon monoxide detector.

As shown in FIG. 4, the smoke and carbon monoxide detector 10 of the present invention utilizes a power source 16 electrically connected to the light bulb socket connector 14 via an electrical wire 18 and the light fixture 15. The power source 16 provides the requisite electricity to power and recharge a battery 20 located internal to an outer case 22 of the detector 10. The battery 20 is preferably a rechargeable Lithium-ion battery. The battery 20 could also incorporate an additional standard 9-volt battery therein. In one embodiment of the present invention, the smoke and carbon monoxide detector 10 incorporates a permanently mounted rechargeable battery and a removable 9-volt battery within the outer case 22. It is preferred in the present invention that the rechargeable battery be non-accessible within the outer case 22 absent destruction of the smoke and carbon monoxide detector 10. Thus, if the traditional 9-volt battery were removed, the smoke and carbon monoxide detector 10 would still be powered by the rechargeable battery. Additionally, the smoke and carbon monoxide detector 10 has a built-in charger to power the rechargeable battery when interconnected with an alternating current (AC) or direct current (DC) power source. If the detector 10 is not hard-wired, the rechargeable battery powers the internal circuitry when the traditional 9-volt battery is removed.

Electricity from the power source 20 is used to recharge the battery 20 of the smoke detector and carbon monoxide detector 10. All that is required to maintain the battery 20 in a sufficiently charged state is that the smoke and carbon monoxide detector 10 be placed in a light fixture 15 that is switched on for a total of one hour per week. Thus, even if the light fixture 15 is turned off or encounters any other situation where the power source 16 is not supplying electricity, the internal battery 20 of the smoke and carbon monoxide detector 10 continues to power the detector 10. Accordingly, the integral battery 20 of the smoke and carbon monoxide detector 10 is recharged and self-powered when the power source 16 supplies electricity thereto.

The smoke and carbon monoxide detector 10 includes the outer case 22 that houses the battery 20, a smoke detector circuitry 24, and a carbon monoxide detector circuitry 26, as referenced generally in FIG. 4. The battery 20 is electrically connected to the electrical wire 18 that supplies electricity to the smoke and carbon monoxide detector 10 from the power source 16. The outer case 22 is made from a material that is moisture and corrosion resistant. The smoke detector circuitry 24 may consist of a photoelectric detector, ionization detector or a combination of detectors known in the art. Additionally, the circuitry of the battery 20, the smoke detector circuitry 24, and the carbon monoxide detector circuitry 26 are also moisture and corrosion resistant through the application of a spray-on silicon. The spray-on silicon protects the circuits and other electrical components of the detector 10 from corrosion or degradation due to moisture in the air. This improved moisture and corrosion resistance increases the effective lifespan of the smoke and carbon monoxide detector 10. Now, a smoke and carbon monoxide detector 10 may be safely placed in areas of high moisture such as the garage, workshop, laundry room, or furnace area.

The smoke and carbon monoxide detector 10 of the present invention is tested via a power switch 28. The smoke detector circuitry 24 and the carbon monoxide detector circuitry 26 are configured such that quick and repetitious flicks of the power switch 28 from an off position to an on position, or vice versa, places the smoke and carbon monoxide detector 10 into a self-test cycle after a short delay. Any combination of flicks may be used to initiate the self-test cycle. Users are not required to actually touch the smoke and carbon monoxide detector 10 to test the alarm. Unlike other smoke detectors or carbon monoxide detectors, users must push a button, flip a switch, or activate another mechanism mounted directly to the smoke detector or the carbon monoxide detector. In these devices, users must be able to readily reach the actual unit. This procedure is particularly laborious if the smoke detector or carbon monoxide detector is mounted to a high or cathedral ceiling. Users risk injury by falling when attempting to reach smoke detectors or carbon monoxide detectors several feet in the air. In the present invention, the power switch 28 provides a convenient and simple mechanism to test the smoke and carbon monoxide detector 10. Typically, the power switch 28 is easy to reach by almost any individual at ground level. No ladders or other lift devices are needed to gain access to the detector 10.

Furthermore, deactivating a false alarm is accomplished in a manner similar to initiating the self-test cycle previously described. To silence a false alarm, users need only repetitiously switch the power switch 28 of/off, or vice versa, in rapid succession for a predetermined number of flicks. In one embodiment, users must repeat the on/off motion twice. After a short delay, the smoke and carbon monoxide detector 10 silences and resets automatically. Again, users are not required to deactivate the alarm by physically touching or engaging the actual detector 10. Alternatively, the present invention should not be limited with respect to the process of testing the smoke and carbon monoxide detector 10 or disabling a false alarm. Any one of a number of combinations involving activation or deactivation of the power source 16 by the power switch 28 or other comparable device known in the art is equally suitable with the present invention. For example, to test the detector 10, a user may simply flick the light switch on, then off once. Alternatively, the user may flick the light switch on, then off, then on again. The important aspect is that a device remote to the actual detector 10 initiates the self-test cycle or deactivates a false alarm.

Figure 5:
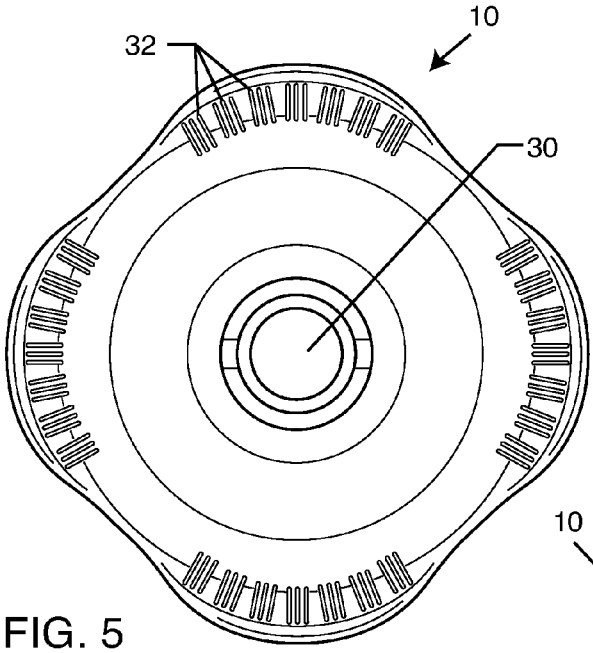
FIG. 5 is a bottom view of the smoke and carbon monoxide detector of the present invention.

The detector 10 of the present invention also incorporates a light socket 30. FIG. 5, illustrates the light socket 30 incorporated into the underside of the smoke and carbon monoxide detector 10. The light socket 30 is generally formed opposite the light bulb socket connector 14. In a preferred embodiment, the light bulb socket 30 is configured to threadingly receive a 110-volt light bulb.

Figure 6:
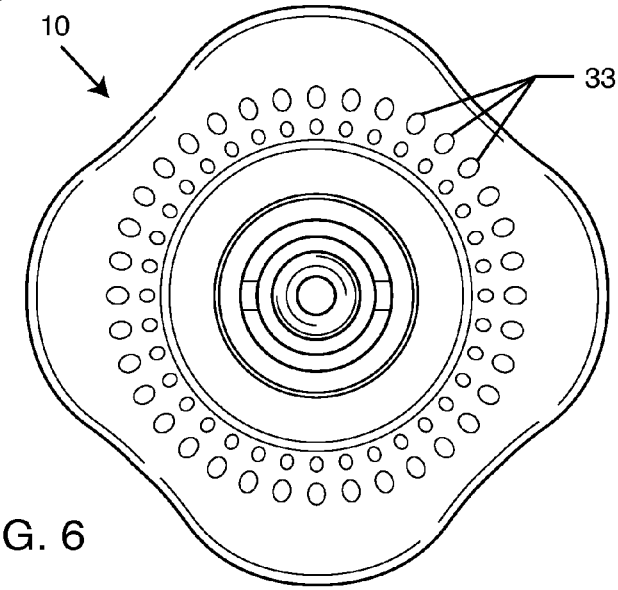
FIG. 6 is a top view of the smoke and carbon monoxide detector.

As shown in FIGS. 5-6, a plurality of apertures 32, 33 are formed in the outer case 22 of the smoke and carbon monoxide detector 10. The apertures 32, 33 provide an entrance for potential smoke or carbon monoxide hazards. Additionally, the apertures 32, 33 function to radiate sound from an alarm located within the interior of the outer case 22, during an emergency. Embedded within the smoke detector circuitry 24 and the carbon monoxide detector circuitry 26 are speakers that issue an audible alarm when either the smoke detector circuitry 24 or the carbon monoxide detector circuitry 26 detects smoke or carbon monoxide, respectively. This speaker may issue a loud audible alarm, such as a beep or buzzing sound, or may issue a pre-recorded message directing users to exits within the building. Furthermore, the smoke and carbon monoxide detector 10 may include a power indicator LED 34, a smoke indicator LED 36 and a carbon monoxide indicator LED 38 that flash or light up in the event of a power failure, fire, or carbon monoxide leak. The power indicator LED 34, the smoke indicator LED 36, and the carbon monoxide indicator LED 38 may all protrude from the outer case 22 as shown in FIG. 1. Alternatively, the LEDs 34, 36, 38 may remain flush with the outer case 22. The important aspect is that the LEDs 34, 36, 38 are visible.

Additionally, another aspect of the present invention is that the smoke and carbon monoxide detector 10 fits into any one of a number of the light fixtures 15. In the schematic shown in FIG. 4, the light bulb socket connection threadingly engages the light fixture 15. The compatibility of the light bulb socket connector 14 with the light fixture 15 allows the detector 10 to be mounted to any one of a number of existing electrical sources within a building. Hence, additional tools, time, and costs associated with mounting an additional smoke detector or carbon monoxide detector is alleviated. Utilizing the light fixture 15 as a lighting source is not lost from insertion of the detector 10 within the light fixture 15. The corresponding light socket 30 is capable of receiving the light bulb 12 so that the light fixture 15 may still be used as a light source. The light bulb 12 is powered from the electrical source 16 via the electrical wire 18, not the battery 20. Therefore, when the power switch 28 cuts off the electricity to the light fixture 15 from the power source 16, any light bulb 12 inserted within the light socket 30 will turn off.

In the previous embodiments, the smoke and carbon monoxide detector 10 is aesthetically pleasing as an additional wall mounted power source or additional ceiling mounted power source is not required for installation. The present invention is also intended to be installed with baton and pendent type lighting fixtures that hang from the ceiling. Moreover, installation within lamp shades that allow the flow of air in, around, and through the apertures 32, 33 in the outer case 22 of the smoke and carbon monoxide detector 10 is also contemplated. Lamp shades that are open at both ends are particularly preferred.

Any one of a number of the 110-volt light bulbs 12 may also be used with the smoke and carbon monoxide detector 10. In one embodiment, conventional light bulbs that have a maximum rating of 75 watts and long life (PL Tube) type bulbs with a similar 75 watt rating are preferred.

Alternatively, in a particularly preferred embodiment of the present invention, a light bulb that utilizes LEDs for illumination can increase the light output from the smoke and carbon monoxide detector 10 without generating additional heat. Thus, it is possible to match the higher wattage conventional tungsten light bulbs without generating the heat associated with those higher wattage bulbs. But, using high wattage tungsten bulbs that generate heat will not adversely effect the operation of the smoke and carbon monoxide detector 10 of the present invention.

Although several embodiments of the present invention have been described in detail for purposes of illustration, various modifications of each may be made without departing from the spirit and scope of the invention. Accordingly, the invention is not to be limited, except as by the appended claims.

What is claimed is:

1. A smoke or fire alarm, comprising:

a base attached to a lamp fixture for conductively coupling the base to a power source through the lamp fixture;

a socket in the base for receiving a portion of a lamp therein to conductively couple the lamp to the power source;

a non-removable rechargeable battery disposed in the base;

a removable battery disposed in the base; and a gas detector disposed in the base and conductively coupled to the batteries.

2. The smoke or fire alarm of claim 1, wherein the rechargeable battery is conductively coupled to the power source.

3. The smoke or fire alarm of claim 1, wherein the gas detector comprises a smoke detector.

4. The smoke or fire alarm of claim 1, wherein the gas detector comprises a carbon monoxide detector.

5. The smoke or fire alarm of claim 1, wherein the base is threadable into a standard 110-volt lamp fixture and the socket is formed to receive a standard 110-volt lamp.

6. The smoke or fire alarm of claim 1, wherein the gas detector further comprises a photoelectric sensor to detect smoke.

7. The smoke or fire alarm of claim 1, including an alarm actable by the gas detector.

8. The smoke or fire alarm of claim 7, including a circuit for testing the alarm when power is initially applied to the base.

9. The smoke or fire alarm of claim 7, wherein the alarm comprises an acoustic alarm.

10. The smoke or fire alarm of claim 9, wherein the acoustic alarm comprises a prerecorded message.

11. The smoke or fire alarm of claim 1, wherein the base comprises a moisture and corrosion resistant enclosure.

12. The smoke or fire alarm of claim 1, including a visual aid that provides notification that the gas detector is powered and operational.

13. A smoke or fire alarm, comprising:

a base attached to a lamp fixture for conductively coupling the base to a power source through the lamp fixture;

a socket in the base for receiving a portion of a lamp therein to conductively couple the lamp to the power source;

a non-removable rechargeable battery disposed in the base and conductively coupled to the power source;

a removable battery disposed in the base;

a gas detector disposed in the base and conductively coupled to the batteries, wherein the gas detector comprises sensors for detecting smoke and carbon monoxide; and an alarm actable by the gas detector.

14. The smoke or fire alarm of claim 13, wherein the gas detector further comprises a smoke detector.

15. The smoke or fire alarm of claim 13, wherein the gas detector further comprises a carbon monoxide detector.

16. The smoke or fire alarm of claim 13, wherein the base is threadable into a standard 110-volt lamp fixture and the socket is formed to receive a standard 110-volt lamp.

17. The smoke or fire alarm of claim 13, including a circuit for testing the alarm when power is initially applied to the base, wherein the alarm comprises an acoustic alarm.

18. The smoke or fire alarm of claim 17, wherein the acoustic alarm comprises a prerecorded message.

19. The smoke or fire alarm of claim 13, wherein the base comprises a moisture and corrosion resistant enclosure.

20. A smoke or fire alarm, comprising:

a base threadable into a standard 110-volt lamp fixture for conductively coupling the base to a power source through the lamp fixture, wherein the base comprises a moisture and corrosion resistant enclosure;

a socket in the base for receiving a portion of a standard 110-volt lamp therein to conductively couple the lamp to the power source;

a non-removable rechargeable battery disposed in the base and conductively coupled to the power source;

a removable battery disposed in the base;

a gas detector disposed in the base and conductively coupled to the batteries, wherein the gas detector comprises a carbon monoxide detector, a smoke detector, or a photoelectric sensor;

an alarm actable by the gas detector, wherein the alarm comprises an acoustic alarm comprising a prerecorded message;

a circuit for testing the alarm when power is initially applied to the base; and a visual aid that provides notification that the battery or gas detector is powered and operational.

* * * * *